US006446373B1

(12) United States Patent
Weinreich

(10) Patent No.: US 6,446,373 B1
(45) Date of Patent: Sep. 10, 2002

(54) DECORATIVE DIGITAL SCREEN

(76) Inventor: Steve Weinreich, 14 Norton Rd., Monmouth Jct., NJ (US) 08852

( * ) Notice: Subject to any disclaimer, the term of this patent is extended or adjusted under 35 U.S.C. 154(b) by 0 days.

(21) Appl. No.: 09/577,105

(22) Filed: May 24, 2000

Related U.S. Application Data

(60) Provisional application No. 60/135,858, filed on May 25, 1999.

(51) Int. Cl.[7] ..... B09F 19/12
(52) U.S. Cl. ..... 40/427; 40/541
(58) Field of Search ..... 40/427

(56) References Cited

U.S. PATENT DOCUMENTS 4,621,443 A * 11/1986 Weinreich ..... 40/427
4,757,626 A * 7/1988 Weinreich ..... 40/427
5,075,993 A * 12/1991 Weinreich ..... 40/444

* cited by examiner

*Primary Examiner*—Cassandra H. Davis

(57) ABSTRACT

A decorative screen, particularly for use in window treatments, interior decoration, and the like, which can be easily customized to complement any decor. The decorative screen uses ambient light, diffusers, and grids to process a crude design. The result is a pleasing mosaic of elements. Just as in a typical tile mosaic, the hue, saturation, and brightness of each element is consistent across that element.

8 Claims, 1 Drawing Sheet

DECORATIVE DIGITAL SCREEN

This invention is related to my previous U.S. Pat. No. 4,621,443, DIGITAL SCREEN DISPLAY APPARATUS and U.S. Pat. No. 4,757,626, DISPLAY APPARATUS the full text of which are incorporated herein by reference. This application is based on my provisional patent application No. 60/135,858, filed on May 25, 1999, DECORATIVE DIGITAL SCREEN, for which I claim priority.

It is the purpose of the present invention to provide a decorative screen, particularly for use in window treatments, interior decoration, and the like, which can be easily customized to complement any decor. The decorative screen shows a mosaic of elements, preferably of similar shape. Just as in a typical tile mosaic, the hue, saturation, and brightness of each element is consistent across that element.

More specifically, a design, preferably multicolored and preferably transparent or translucent (at least in part), is prepared (by ordinary means) on or as a transparent or translucent substrate (such as polyester film, glass, rice paper, or shadecloth). This design substrate is then made to be a layer inside a digitizing panel, forming the decorative digital screen.

The digitizing panel is constructed of two sheets of diffusing material (such as etched glass or tracing paper or fine mesh fabric) placed in close proximity (and essentially parallel) to the exposed faces of at least one grid. A grid is a cellular (e.g., honeycomb or eggcrate) structure (which may be regular or irregular and), which transmits light more readily through its thickness (i.e., perpendicular to the walls between cells) than it transmits light between cells. The faces of a grid are the two generally parallel surfaces defining the thickness of the grid. An exposed face of a grid is one which, before a design substrate is installed, is not in close proximity to another grid.

It is preferred that the cell walls be opaque and matte white in color. It is preferred that the cell walls be parallel and of uniform thickness. The grid is made by ordinary means used to make cellular structures, including, but not limited to, molded plastic (as an integral grid) and metal strips (slit halfway across at regular intervals and assembled into a grid).

The thickness of the digitizing panel is preferably about equal to the greatest distance across a cell. The digitizing panel may have a frame to secure the layers of the digitizing panel to each other or merely for decoration.

The design substrate may be installed in the digitizing panel during manufacture or (particularly for rigid digitizing panels) through a slot at an edge or by removal of a frame or by unzipping a diffuser or by other ordinary means. It is preferred that the design substrate be replaceable.

In the preferred embodiment, the design substrate is placed between two grids. The decorative digital screen then comprises (starting at either face) a diffuser, a grid, the design substrate, a grid, and a diffuser. The grids are preferably congruent and in register, but need not be either.

When such a decorative digital screen is illuminated from either face, the opposite face displays a mosaic pattern which is a digitized representation of the design on the design substrate. Digitization of the design make the design appear more orderly, more polished than the unprocessed design. It is therefore possible to turn a crudely made design into a pleasing display. Thus, the decorative digital screen allows one of limited skill (or limited time) to use a crudely made design as part of a finished project.

Alternatively, the design can be a more finished work, which is then transformed into a distinctive, mosaic form by the digitizing process.

The decorative digital screen can be (or can be a segment of) a window shutter, shade, or blind; a lampshade; a privacy screen; or other decorative object. The decorative digital screen can be implemented entirely of soft materials, such as tissue paper or fabric, so that it may be rolled like a window shade or drawn like a drape.

For uses where one side will always be the illuminated side, e.g. a lampshade, the preferred decorative digital screen has only one grid and the design substrate is placed between the diffuser of the illuminated side and the one grid. Alternatively, the design can be applied to one of the sheets of diffusing material, preferably on the side facing a grid. The diffusing material then acts as both diffuser and design substrate.

In the Figures, like elements have been numbered alike.

Figure 1:
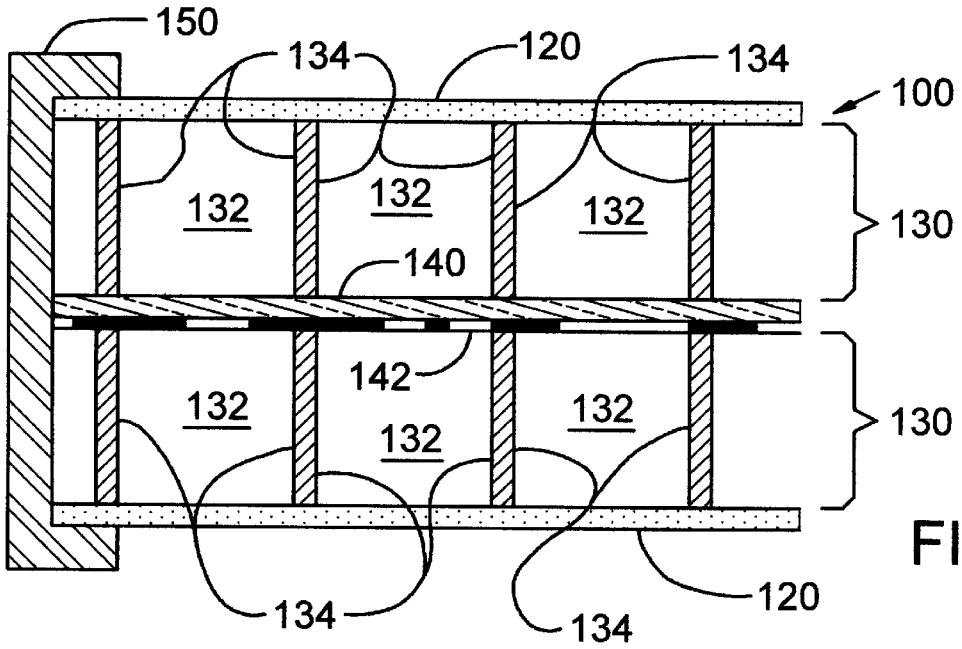
FIG. 1 shows a section through a two-faced decorative digital screen.

Referring to FIG. 1, ambient or directed light falls upon a first face (which may be either face) of the decorative digital screen 100. The light diffuses through a first transmissive diffuser 120 and is additionally reflectively diffused by the preferably matte white walls 134 of the cells 132 of a first grid 130. The light then passes through the design substrate 140 with the design 142 on its surface.

As the light passes through the design 142, it is filtered by the hue, saturation, and brightness of whatever elements of the design it encounters.

Being further transmissively diffused (by a translucent design substrate 140 or design 142) or not (through a transparent design substrate 140 or design 142), the light then impinges on the matte white walls 134 of the cells 132 of a second grid 130, by which it is further reflectively diffused, to impinge upon a second transmissive diffuser 120. The light is thereby directed to the eyes of observers. The hue, saturation, and brightness will be usefully consistent across the area of each cell.

Thus the original design, which can be rather crudely drawn/painted/constructed, remains invisible but produces an attractive mosaic image.

The generally planar elements of the decorative digital screen are retained by a frame 150. The diffusers 120 can be glued to or integral with the grids 130 while the design substrate 140 is still easy to replace by removal of the frame 150.

Figure 2:
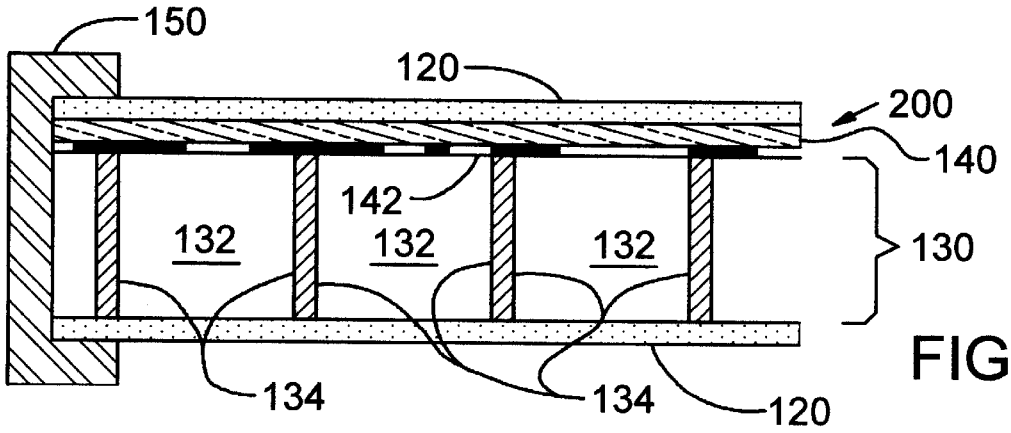
FIG. 2 shows a section through a one-faced decorative digital screen.

In the embodiment of FIG. 2, the decorative digital screen is functional from only one side. The decorative digital screen 200 functions in much the same way as that of FIG. 1, with the exception of reflective diffusion by the walls of a first grid.

Figure 3:
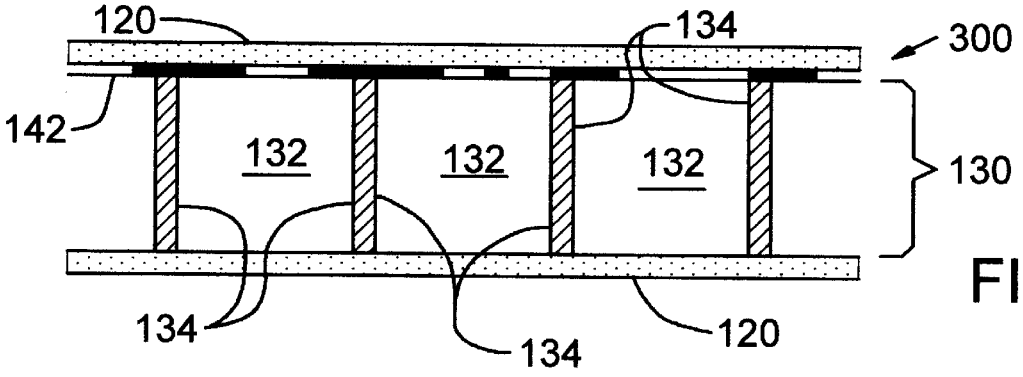
FIG. 3 shows a section through a one-faced decorative digital screen, wherein the design is applied to a diffuser.

The embodiment of the decorative digital screen 300 of FIG. 3 functions identically to that of FIG. 2, but there is no independent substrate for the design.

In general, while the Invention has been described with reference to specific embodiments thereof, it will be appreciated by those of ordinary skill in the art that modifications can be made to the Invention without departing from the spirit and scope thereof.

I claim:

1. A decorative digital screen comprising:

a first grid, having two faces and comprised of cells with cell walls, and two diffusers, the first grid positioned between the two diffusers, each of the two diffusers essentially parallel to a face of the first grid, at least one of the two diffusers in generally close proximity to the first grid, and a design, positioned between the two diffusers.

2. The decorative digital screen of claim 1, also comprising:

a second grid, having two faces and comprised of cells with cell walls, positioned essentially parallel to and in generally close proximity to the first grid, both grids positioned between the two diffusers with one of the two diffusers in generally close proximity to each of the grids.

3. The decorative digital screen of claim 1, also comprising:

a design substrate, to which the design is applied.

4. The decorative digital screen of claim 2, wherein the design is positioned between the first grid and the second grid.

5. The decorative digital screen of claim 2, wherein the second grid is congruent to the first grid.

6. The decorative digital screen of claim 5, wherein the second grid is in register with the first grid.

7. The decorative digital screen of claim 1, wherein the cell walls comprise reflective diffusers.

8. A digitizing panel comprising:

two grids, each grid having two faces and comprised of cells with cell walls, positioned essentially parallel to and in generally close proximity to one another, and a space between the two grids, to accommodate a design substrate, and two diffusers, the two grids being positioned between them, each of the two diffusers essentially parallel to and in generally close proximity to a face of one of the grids.

* * * * *